US006752136B1

(12) United States Patent
Anderson

(10) Patent No.: US 6,752,136 B1
(45) Date of Patent: Jun. 22, 2004

(54) ARCHERY BOW FOR SHOOTING A SABOT CONTAINING A PLURALITY OF DARTS OR SHOT PELLETS

(76) Inventor: Jeffrey R. Anderson, P.O. Box 566, Wauconda, IL (US) 60084

( * ) Notice: Subject to any disclaimer, the term of this patent is extended or adjusted under 35 U.S.C. 154(b) by 0 days.

(21) Appl. No.: 10/395,778

(22) Filed: Mar. 24, 2003

(51) Int. Cl.[7] ..... F41B 5/00
(52) U.S. Cl. ..... 124/24.1; 124/41.1
(58) Field of Search ..... 124/44.5, 45, 24.1, 124/26, 41.1, 81, 88

(56) References Cited

U.S. PATENT DOCUMENTS 3,662,686 A * 5/1972 Baldini ..... 102/523
4,827,847 A * 5/1989 Laviolette et al. ..... 102/503
4,829,974 A 5/1989 Anderson ..... 124/24 R
4,958,617 A 9/1990 Anderson ..... 124/24.1
5,119,797 A 6/1992 Anderson ..... 124/25
5,263,465 A 11/1993 Anderson ..... 124/24.1
6,142,133 A 11/2000 Anderson ..... 124/25.6

* cited by examiner

*Primary Examiner*—Jacob K. Ackun, Jr.
(74) *Attorney, Agent, or Firm*—Rolland R. Hackbart

(57) ABSTRACT

A novel handheld compound archery bow (100) includes a riser (102) with a keyhole, an arrow rest assembly (150) extending through the keyhole, a bowstring (130), and a grip (106). A sabot (300) including top and bottom halves (301 & 302) each having three slots (310, 311 & 312) for holding two darts (200), such that a total of twelve darts may be loaded into the sabot. The top and bottom halves (301 & 302) once loaded with darts (200) are held together by rubber O-rings (380 & 381). The sabot (300) has a rectangular cross section and inserts into a corresponding rectangular opening in the muzzle end (152) of the arrow rest assembly (150). When shot from the novel handheld compound archery bow (100), the top and bottom halves (301 & 302) of the sabot (300) separate allowing the twelve darts (200) to continue unimpeded in flight toward a target. The twelve darts (200) disperse in an expanding pattern as they travel toward the target. The novel handheld compound archery bow (100) may be advantageously utilized for bird or small game hunting.

39 Claims, 5 Drawing Sheets

ARCHERY BOW FOR SHOOTING A SABOT CONTAINING A PLURALITY OF DARTS OR SHOT PELLETS

FIELD OF THE INVENTION

The present invention relates generally to the field of archery bows, and more particularly to a handheld archery bow that shoots a sabot containing a plurality of darts or shot pellets.

BACKGROUND OF THE INVENTION

A conventional handheld compound archery bow includes a riser coupled to top and bottom limbs and further includes top and bottom cams or wheels that each have an axle coupling it to the end of the respective limb. A grip is located on the riser approximately at the midpoint between the axle of the top cam and the axle of the bottom cam. An arrow rest is typically located on the riser just above the top of the grip. A single arrow is drawn back by the archer and released toward the target. The arrow needs to be longer than the draw length of the archer so that it extends beyond the front of the bow at full draw. The compound archery bow shown and described in my U.S. Pat. Nos. 4,829,974, 4,958,617, 5,119,797, 5,263,465 and 6,142,133 also shoots a single arrow, but it can be shorter than the draw length of the archer. Since only one arrow can be shot at a time, conventional handheld compound bows cannot shoot multiple arrows in a pattern similar to the pattern provided by shot pellets fired from a shotgun. Thus, a conventional handheld compound bow is not well suited for bird or small game hunting. Accordingly, there is a need for an improved handheld compound archery bow that is capable of simultaneously shooting a plurality of darts or shot pellets that disperse in a pattern.

BRIEF DESCRIPTION OF DRAWINGS

FIGS. 15 & 16 are views of the sabot in FIG. 14 at rest in the arrow rest assembly when viewed from the muzzle end and the breach end of the arrow rest assembly, respectively.

DETAILED DESCRIPTION OF THE PREFERRED EMBODIMENTS

A handheld archery bow illustrative of my invention comprises: first and second limbs, each having first and second ends; a riser to receive the first end of the first and second limbs; a first cam with an axle to couple to the second end of the first limb; a second cam with an axle to couple to the second end of the second limb; a bowstring extending between the first cam and the second cam; a string release; an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least one slot adapted to receive at least one projectile, the sabot having a front end and a nock end for engaging the bowstring, and the top portion and a bottom portion adapted to separate when launched to release the projectiles.

A sabot illustrative of my invention is adapted to be launched from an arrow rest assembly of a handheld archery bow having a bowstring, the arrow rest assembly comprised of an elongated track coupled to a riser and having a muzzle end and a breach end adapted to be coupled to a string release, and the sabot comprising: a front end and a nock end for engaging the bowstring; a top portion and a bottom portion adapted to be inserted into the muzzle end of the elongated track; the top portion and the bottom portion each having at least one slot adapted to receive at least one projectile; and the top portion and the bottom portion each adapted to separate when launched to release the projectiles.

Figure 1:
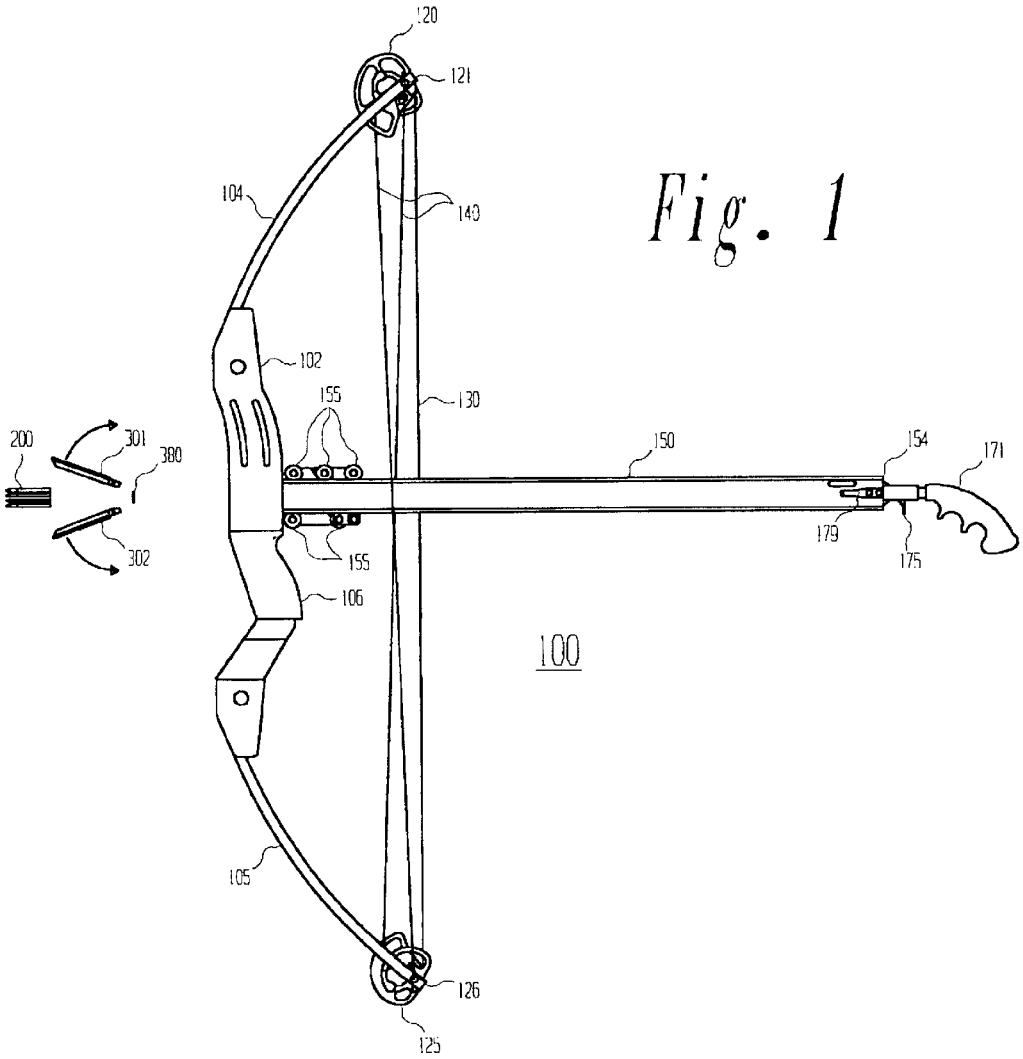
FIG. 1 is a left-side view of a handheld compound archery bow together with a plurality of darts, top and bottom halves of a sabot and a rubber grommet shortly after being launched, illustrative of a preferred embodiment of my invention.

Referring now to FIG. 1, there is illustrated a side view of a handheld compound archery bow 100 a handheld compound archery bow together with a plurality of projectiles or darts 200, top and bottom halves 301 & 302 of a sabot 300 and a rubber grommet 380 shortly after being launched, illustrative of a preferred embodiment of my Invention. Bow 100 includes a riser 102, first and second limbs 104 and 105, top cam or wheel 120, bottom cam or wheel 125, bowstring 130, harness 14, and arrow rest assembly 150. A grip 106 is coupled to the riser 102, such that the top portion thereof is approximately at the horizontal center line of bow 100, a line which is half way between axes 121 & 126 of top and bottom cams 120 & 125.

The arrow rest assembly 150 is comprised of an elongated track having a muzzle end 152 (see FIG. 2) and a breach end 154 (see FIG. 1). The muzzle end 152 of the arrow rest assembly 150 extends through a keyhole in the riser 102 (see FIG. 1 of my U.S. Pat. No. 6,142,133, incorporated herein in its entirety by reference) and is supported on rollers 155 mounted to riser 102. The arrow rest assembly 150 is disposed above the grip 106 and substantially perpendicular to the bowstring 130. A dual-caliper string release (see FIG. 1 of my copending patent application, Ser. No. 10/307,065, filed Nov. 29, 2002 and entitled "Archery Bow With Zero Brace Height", incorporated in its entirety by reference) with trigger 175 and string release grip 171 (both commercially available components) are attached to the breach end 154 of the arrow rest assembly 150. A spring 179 is disposed on the side or arrow rest assembly 150 near the breach end 154 for engaging and holding in place sabot 300 when inserted.

Figure 2:
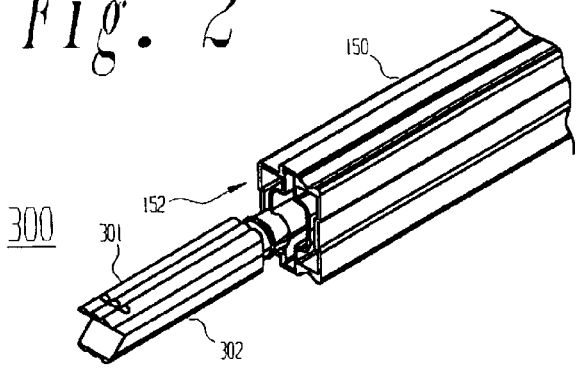
FIG. 2 is a close up view of a section of the arrow rest assembly of the handheld compound archery bow in FIG. 1, showing the sabot at the point where it has just cleared the muzzle end of the arrow rest assembly.
Figure 3:
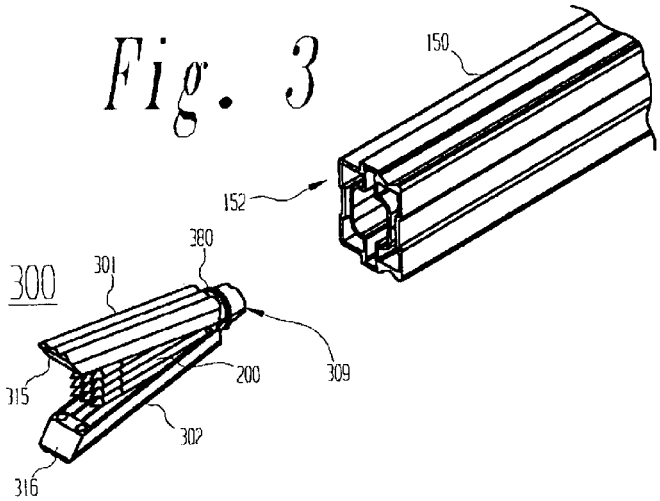
FIG. 3 is a close up view of a section of the arrow rest assembly of the handheld compound archery bow in FIG. 1, where the top half and bottom halves of the sabot begin to separate.

Referring now to FIG. 2, there is illustrated a close up view of a section of arrow rest assembly 150 showing sabot 300 at the point where it has just cleared the muzzle end 152 thereof. According to a novel feature of my invention, as sabot 300 moves away from muzzle end 152 of the arrow rest assembly 150, air flow exerts forces against beveled surfaces 315 & 316 causing top portion or half 301 and bottom portion or half 302 to begin to separate as shown in FIG. 3. Shortly thereafter, top and bottom halves 301 & 302 completely separate as shown in FIG. 1, allowing darts 200 to continue unimpeded in flight toward a target. Darts 200 disperse in an expanding pattern as they substantially simultaneously travel toward the target. As top and bottom halves 301 & 302 separate, rubber O-ring 380 falls off the nock end 309 of sabot 300. Top and bottom halves 301 & 302 may be of a bright color, such as bright orange or bright yellow so that they may be retrieved and reused.

Figure 4:
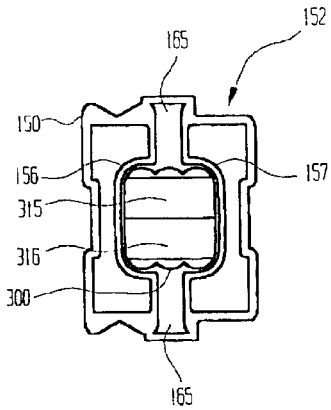
FIGS. 4 & 5 are views of the sabot in FIG. 1 at rest in the arrow rest assembly when viewed from the muzzle end and the breach end of the arrow rest assembly, respectively.
Figure 5:
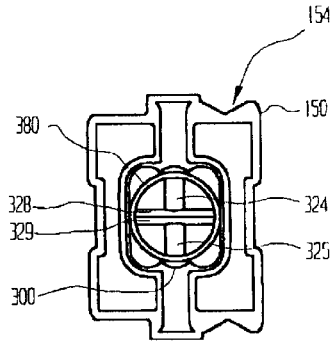

Referring now to FIGS. 4 & 5, there are illustrated views of sabot 300 at rest in the arrow rest assembly 150 when viewed from the muzzle end 152 and the breach end 154 thereof, respectively. In FIG. 4, arrow rest assembly 150 includes walls 156 & 157 that form a rectangular guide channel for enclosing and guiding sabot 300. The walls 156 & 157 also form string channel 165 through which the released bowstring 130 passes from the breach end 154 toward the muzzle end 152 to propel the sabot 300 from the arrow rest assembly 150. Arrow rest assembly 150 is preferably extruded from aluminum stock. In other embodiments, strips of polyurethane (or other suitable material) may be used in arrow rest assembly 150 to form a rectangular guide channel for enclosing and guiding sabot 300. The front end 308 of sabot 300 has beveled surfaces 315 & 316 that can be seen from the muzzle end 152 of arrow rest assembly 150 in FIG. 4. The front end 308 of the preferred embodiment of sabot 300 has a width of approximately ⅝ inches and a height of approximately ¾ inches. In FIG. 5, the nock end 309 of the sabot 300 has string guide slots 324 & 325. Beveled surfaces 328 & 329 of nock end 309 are also shown in FIG. 5.

Referring now to FIGS. 6, 7, 8 & 9, there is illustrated sabot 300 with top and bottom halves 301 and 302, illustrative of a preferred embodiment of my invention. Top half 301 is substantially identical to bottom half 302, thereby simplifying the manufacture thereof. Top and bottom halves 301 & 302 may be formed of molded thermoplastic or any other suitable light material, such as, for example compressed paper. Making top and bottom halves 301 & 302 as light as practical imparts more energy to darts 200.

Figure 6:
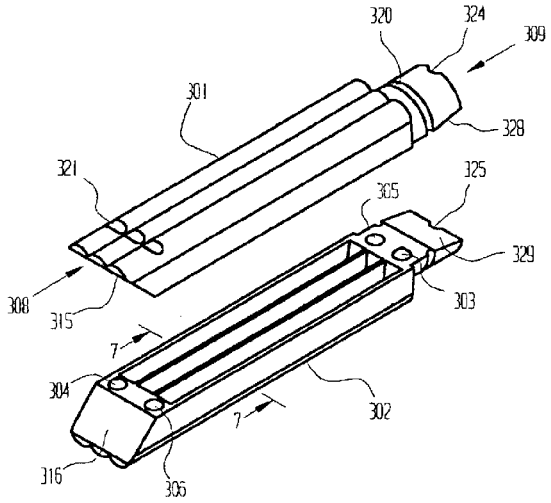
FIGS. 6, 7, 8 & 9 illustrate in more detail the top and bottom halves of the sabot in FIG. 1.
Figure 8:
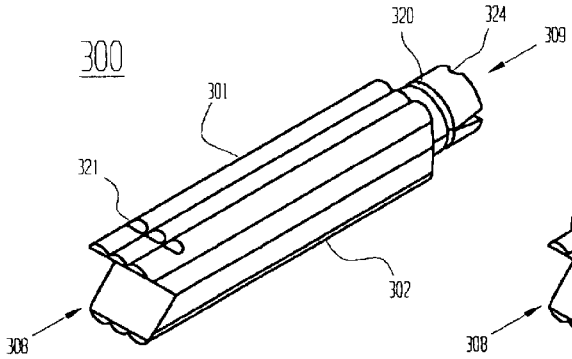

Top half 301 in FIG. 6 has a front end 308, beveled surface 315, three guide slots 321 for O-ring 381, a guide slot 320 for O-ring 380, beveled surface 328, and string guide slot 324 at nock end 309. The length of top and bottom halves 301 and 302 from the front end 308 to the back end 309 is approximately 3 ¼ inches. Bottom half 302 in FIG. 6 has beveled surface 316 at front end 308, protrusions 303 & 304, holes 305 & 306 adapted to receive the protrusions 303 & 304 in top half 301, beveled surface 329, and string guide 325 at nock end 309. Beveled surfaces 315 & 316 extend inward at a 45 degree angle, so that they form a 90 degree angle as shown in FIG. 8. Beveled surfaces 328 & 329 also extend inward but at a much smaller angle than beveled surfaces 315 & 316. Nock end 309 of sabot 300 has a circular cross section that is smaller than the cross section of the rectangular front end 308, so that O-ring 380 does not touch the guide channel walls 156 & 157 of the arrow rest assembly 150 as shown in FIG. 5. In other embodiments of sabot 300, the nock end 309 may have a rectangular cross section similar to that of the front end 308.

Figure 7:
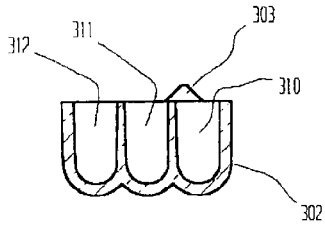
Figure 9:
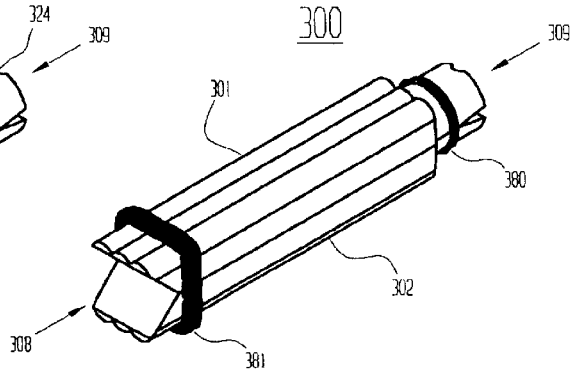

Top and bottom halves 301 & 302 each have three slots or channels 310, 311 and 312 as shown more clearly in the cross section of bottom half 302 in FIG. 7. Protrusion 303 is also shown in FIG. 7. According to a novel feature of my invention, each slot 310, 311 and 312 will hold two darts 200, such that sabot 300 holds twelve darts 200 when fully loaded top and bottom halves 301 and 302 are assembled together, as shown in FIGS. 8 & 9 and in FIG. 3. Slots 310, 311 and 312 may also be loaded with steel or lead shot pellets as well as other suitably sized projectiles with or without cutting or sharp edges. In other embodiments, any suitable number of slots 310, 311 & 312 may be used in sabot 300 depending on the size thereof and the size of the darts, shot pellets or projectiles, such as for example, one slot, two slots, or three slots. In FIG. 9, rubber O-ring 381 is positioned in guide slots 321 of the top and bottom halves 301 & 302, and rubber O-ring 380 is positioned in guide slot 320 of the top and bottom halves 301 & 302. As shown in FIG. 2, O-ring 381 is removed when sabot 300 is inserted into the muzzle end 152 of the arrow rest assembly 150. O-ring 381 and O-ring 380 hold the top and bottom halves 301 & 302 together when sabot 300 is carried in a pocket, bow quiver or other packaging or carrying device. O-rings 380 & 381 may be replaced by any other suitable resilient or flexible elements that hold top and bottom halves 301 & 302 of sabot 300 together.

Figure 10:
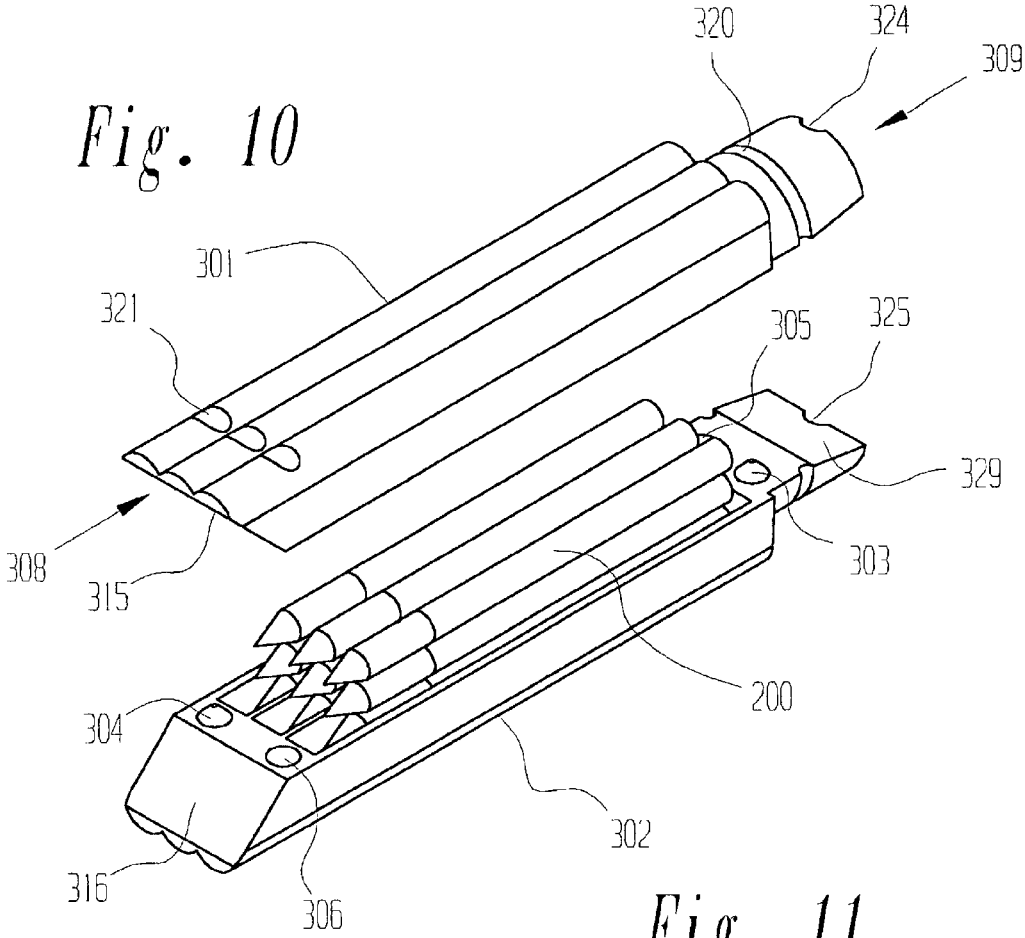
FIGS. 10 and 11 illustrate a dart that may be inserted into the sabot in FIG. 1.
Figure 11:
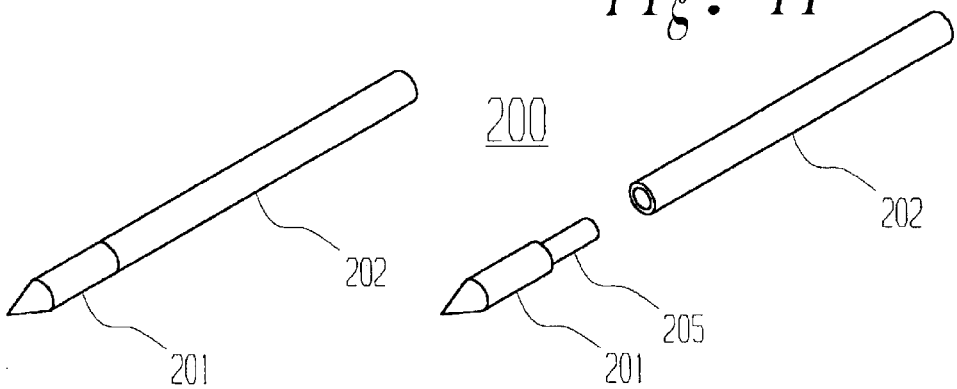

Referring now to FIGS. 10 & 11, there is illustrated in more detail darts 200 for use in sabot 300, illustrative of a preferred embodiment of my invention. In FIG. 11, dart 200 includes rigid tubing 202 coupled to pointed tip end 201. Pointed tip end 201 can be made of steel, brass, tungsten or other suitable metal. Tubing 202 is hollow, rigid tubing that fits over a smaller diameter portion 205 of pointed tip end 201. Tubing 202 may be thermoplastic or any other suitable rigid, light weight material. Pointed tip end 201 of dart 200 has a so-called bullet point, although a field point, chisel point, or any other suitably shaped point may be used in other embodiments. Darts 200 are approximately two inches long and ⅛ inch in diameter. Darts 200 exhibit good aerodynamic properties when loaded into top and bottom halves 301 & 302 of sabot 300 and shot from archery bow 100 in FIG. 1. According to a novel feature of my invention, when sabot 300 is shot from bow 100, the twelve darts 200 disperse in an expanding pattern that is approximately six inches wide at a distance of fifteen yards.

Figure 12:
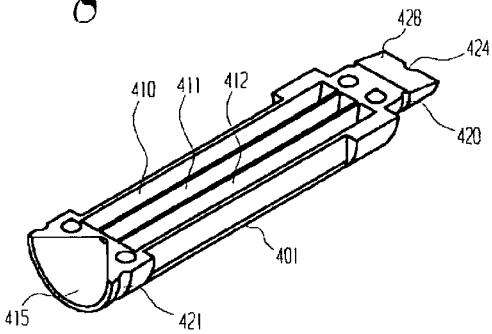
FIGS. 12, 13, 14, 15 & 16 illustrate an alternative embodiment of a sabot that may be utilized in practicing my invention
Figure 13:
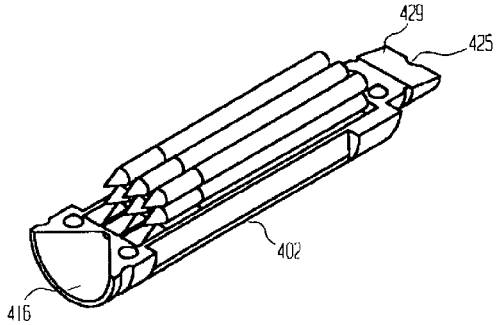
Figure 14:
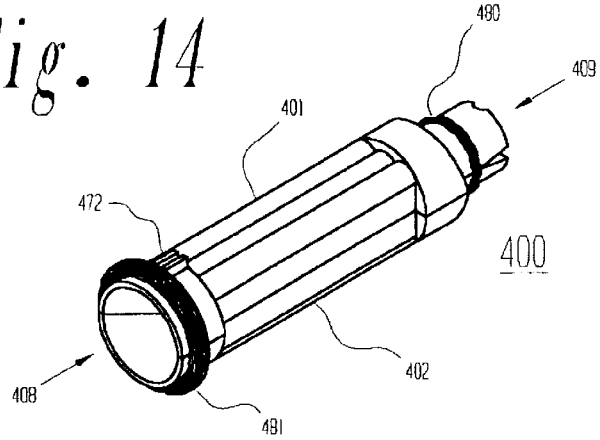

Referring now to FIGS. 12, 13, 14, 15 & 16, there is illustrated a sabot 400 with top and bottom halves 401 and 402, illustrative of an alternative embodiment of my invention. Top half 401 in FIG. 12 is substantially identical to bottom half 402 in FIG. 13, thereby simplifying the manufacture thereof. Top half 401 in FIG. 12 has a convex conical surface 415, guide slot 421 for O-ring 481, slots 410, 411 & 412, a guide slot 420 for O-ring 480, beveled surface 428, and string guide slot 424. The length of top and bottom halves 401 and 402 from the front end 408 to the back end 409 is approximately 3 ¼ inches. Bottom half 402 in FIG. 13 has a convex conical surface 416, beveled surface 429, and string guide 425. Top and bottom halves 401 & 402 each have three slots or channels 410, 411 and 412. According to a novel feature of my invention, each slot 410, 411 and 412 will hold two darts 200 as shown in FIG. 13, such that sabot 400 holds twelve darts 200 when fully loaded top and bottom halves 401 and 402 are assembled together as shown in FIGS. 13 & 14. In FIG. 14, rubber O-ring 481 is positioned in guide slot 421 of the top and bottom halves 401 & 402, 20 and rubber O-ring 480 is positioned in guide slot 420 of the top and bottom halves 401 & 402.

Figure 15:
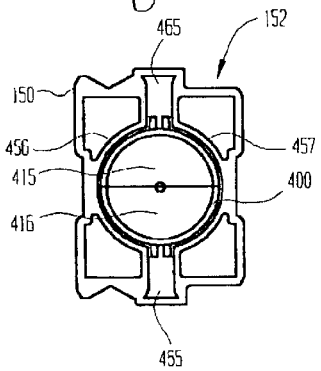
Figure 16:
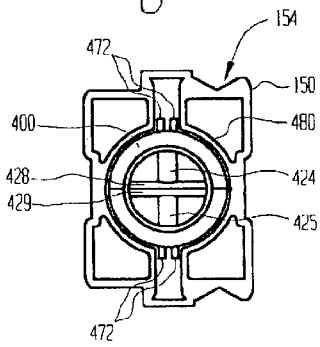

Referring now to FIGS. 15 & 16, there are illustrated views of a sabot 400 at rest in the arrow rest assembly 150 when viewed from the muzzle end 152 and the breach end 154 thereof, respectively. In FIG. 15, arrow rest assembly 150 includes walls 456 & 457 that from a circular guide channel for enclosing and guiding sabot 400. The walls 456 & 457 also form the string channel 465 through which the released bowstring 130 passes from the breach end 154 toward the muzzle end 152 to propel the sabot 400 from the arrow rest assembly 150. The front end 40B of sabot 400 has convex conical surfaces 415 & 416 that can be seen from the muzzle end 152 of arrow rest assembly 150 in FIG. 15. The front end 408 of sabot 400 has a diameter of approximately ¾ inches. The length of sabot 400 from the front end 408 to the back end 409 is approximately 3 ¼ inches. In FIG. 16, the nock end 409 of the sabot 400 has string guide slots 424 & 425. Also shown in FIG. 16 are projections 472 on top and bottom halves 401 & 402 that insert partially into string channel 465 for positioning sabot 400 with respect to the arrow rest assembly 150.

Compound archery bow 100 in FIG. 1 may be operated as shown and described in my U.S. Pat. Nos. 4,829,974, 4,958,617, 5,119,797, 5,263,465 and 6,142,133, incorporated herein in their entirely by reference thereto. In order to load and shoot a sabot 300 from the compound archery bow 100 in FIG. 1, the arrow rest assembly 150 is pushed forward until the string release touches the bowstring 130. The trigger 175 is pushed forward so that the dual calipers of the string release capture the bowstring 130. Next, the arrow rest assembly 150 is pointed upward and a sabot 300 is inserted into the muzzle end 152 thereof. The rectangular guide channel formed by walls 156 & 157 guides the sabot 300 that is inserted into the muzzle end 152 of the arrow rest assembly 150. A spring 179 on the side of the arrow rest assembly 150 at the breach end 154 is lifted to allow the nock end of the sabot 300 to come into contact with the bowstring 130. The spring 179 applies a force to the sabot 300 in the arrow rest assembly 150 so that the sabot 300 does not inadvertently fall out if bow 100 is point downward. Then, in order to shoot, the left hand grasps grip 106, and the bow 100 is drawn in the normal manner by the right hand pulling on the string release grip 171. Bow 100 may also be shot with the right hand grasping grip 106 and the left hand grasping string release grip 171. The arrow rest assembly 150 reciprocates back on quiet rollers to the fully-drawn position and is held by hand at full draw. Next, the trigger 175 on the string release is pulled back to release the bowstring 130 and propel the sabot 300. During the release, the hand holding the string release grip 171 is firmly anchored against the cheek. The bow 100 is held steady by one hand on the grip 106 and the other hand on the string release grip 171. After releasing the bowstring 130 and the sabot 300, the arrow rest assembly 150 is pushed forward so that the dual calipers of the release capture the bowstring 130 in preparation for another shot. Another sabot 300 may then be loaded into the breach end 152 of the arrow rest assembly 150, and the process described above is repeated to shoot the newly loaded sabot 300.

Thus, a novel handheld archery bow 100 has been described that can advantageously shoot sabots 300 or 400 containing twelve darts 200 that disperse in an expanding pattern as they substantially simultaneously travel toward a target. Since darts 200 disperse in a pattern, the novel handheld bow 100 together with sabots 300 or 400 loaded with darts 200 may be effectively used for bird or small game hunting. In other embodiments, top and bottom halves 301 & 302 of sabot 300 each may be formed of multiple portions that separate when sabot 300 is launched. Although sabots 300 & 400 have rectangular and circular cross sections, respectively, any other suitable cross section may be used, such as, for example square, trapezoidal or elliptical cross sections.

While particular embodiments of my invention have been shown and described, modifications may be made. It is therefore intended in the appended claims to cover all such changes and modifications which fall within the true spirit and scope of my invention.

What is claimed is:

1. An archery bow, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first cam and the second cam;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least one slot adapted to receive at least one projectile, the sabot having a front end and a nock end for engaging the bowstring, and the top portion and a bottom portion each have a front end that has a surface angled inwardly and being adapted to separate when launched to release the projectiles.

2. The archery bow according to claim 1, wherein the front ends of the top portion and the bottom portion of the sabot each have a beveled surface that extends inward.

3. The archery bow according to claim 1, wherein the sabot has a rectangular cross section.

4. The archery bow according to claim 1, wherein the front ends of the top portion and the bottom portion of the sabot each have a convex conical surface.

5. The archery bow according to claim 1, wherein the sabot has a circular cross section.

6. The archery bow according to claim 1, further including at least one projectile in each slot and wherein the projectile is a dart.

7. The archery bow according to claim 1, further including at least one projectile in each slot and wherein the projectile is a plurality of shot pellets.

8. The archery bow according to claim 1, wherein the arrow rest assembly has extruded walls that form a channel for guiding the sabot.

9. An archery bow, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first cam and the second cam;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a to portion and a bottom portion each having at least three slots each adapted to receive at least two darts, the sabot having a front end and a nock end for engaging the bowstring, and the top portion and a bottom portion adapted to separate when launched to release the darts.

10. The archery bow according to claim 9, further including at least two darts in each slot and wherein each dart has a pointed tip end coupled to rigid tubing.

11. The archery bow according to claim 9, wherein the sabot has a substantially circular cross section, and the top portion and the bottom portion of the sabot each have a front end that has a convex conical surface.

12. The archery bow according to claim 9, wherein the sabot has a substantially rectangular cross section, and the top portion and the bottom portion of the sabot each have a front end that has a beveled surface that extends inward.

13. The archery bow according to claim 9, wherein the arrow rest assembly has extruded walls that form a channel for guiding the sabot.

14. A sabot adapted to be launched from an arrow rest assembly of an archery bow having a bowstring, the arrow rest assembly comprised of an elongated track coupled to a riser and having a muzzle end and a breach end adapted to be coupled to a string release, said sabot comprising:

a front end and a nock end for engaging the bowstring;

a top portion and a bottom portion adapted to be inserted into the muzzle end of the elongated track;

the top portion and the bottom portion each having at least one slot adapted to receive at least one projectile; and the top portion and the bottom portion each having a front end that has a surface angled inwardly and being adapted to separate when launched to release the projectiles.

15. The sabot according to claim 14, wherein the front ends the top portion and the bottom portion of the sabot each have a beveled surface that extends inward.

16. The sabot according to claim 14, wherein the sabot has a rectangular cross section.

17. The sabot according to claim 14, wherein the front ends of the top portion and the bottom portion of the sabot each have a convex conical surface.

18. The sabot according to claim 14, wherein the sabot has a circular cross section.

19. The sabot according to claim 14, further including at least one projectile in each slot and wherein the projectile is a dart.

20. The sabot according to claim 19, wherein the dart has a pointed tip end coupled to rigid tubing.

21. The sabot according to claim 14, further including at least one projectile in each slot and wherein the projectile is a plurality of shot pellets.

22. A sabot adapted to be launched from an arrow rest assembly of an archery bow having a bowstring, the arrow rest assembly comprised of an elongated track coupled to a riser and having a muzzle end and a breach end adapted to be coupled to a string release, said sabot comprising:

a front end and a nock end for engaging the bowstring;

a top portion and a bottom portion adapted to be inserted into the muzzle end of the elongated track;

the top portion and the bottom portion each having at least three slots each adapted to receive at least two projectiles; and the top portion and the bottom portion each adapted to separate when launched to release the projectiles.

23. The sabot according to claim 22, further including at least two projectiles in each slot and wherein each projectile is a dart that has a pointed tip end coupled to rigid tubing.

24. The sabot according to claim 22, wherein the sabot has a substantially circular cross section, and the top portion and the bottom portion of the sabot each have a front end that has a convex conical surface.

25. The sabot according to claim 22, wherein the sabot has a substantially rectangular cross section, and the top portion and the bottom portion of the sabot each have a front end that has a beveled surface that extends inward.

26. An archery bow, comprising:

first and second limbs, each having first and second ends;

a riser to receive the first end of the first and second limbs;

a first wheel with an axle to couple to the second end of the first limb;

a second wheel with an axle to couple to the second end of the second limb;

a bowstring extending between the first wheel and the second wheel;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least one slot adapted to receive at least one projectile, the sabot having a front end and a nock end for engaging the bowstring, and the top portion and a bottom portion each have a front end that has a surface angled inwardly and being adapted to separate when launched to release the projectiles.

27. The archery bow according to claim 26, wherein the sabot has a rectangular cross section.

28. The archery bow according to claim 26, wherein the sabot has a circular cross section.

29. The archery bow according to claim 26, further including at least one projectile in each slot and wherein the projectile is a dart.

30. The archery bow according to claim 26, further including at least one projectile in each slot and wherein the projectile is a plurality of shot pellets.

31. The archery bow according to claim 26, wherein the arrow rest assembly has extruded walls that form a channel for guiding the sabot.

32. An archery bow, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first cam and the second cam;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least three slots each adapted to receive at least one projectile, the sabot having a front end and a nock end for engaging the bowstring, and the top portion and a bottom portion adapted to separate when launched to release the projectiles.

33. An archery bow, comprising:

first and second limbs, each having first and second ends;

a riser to receive the first end of the first and second limbs;

a first cam with an axle to couple to the second end of the first limb;

a second cam with an axle to couple to the second end of the second limb;

a bowstring extending between the first cam and the second cam;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least one slot adapted to receive at least one projectile, the sabot having a front end and a nock end with a string guide slot for engaging the bowstring, and the top portion and a bottom portion adapted to separate when launched to release the projectiles.

34. A sabot adapted to be launched from an arrow rest assembly of an archery bow having a bowstring, the arrow rest assembly comprised of an elongated track coupled to a riser and having a muzzle end and a breach end adapted to be coupled to a string release, said sabot comprising:

a front end and a nock end for engaging the bowstring;

a top portion and a bottom portion adapted to be inserted into the muzzle end of the elongated track;

the top portion and the bottom portion each having at least three slots each adapted to receive at least one projectile; and the top portion and the bottom portion each adapted to separate when launched to release the projectiles.

35. A sabot adapted to be launched from an arrow rest assembly of an archery bow having a bowstring, the arrow rest assembly comprised of an elongated track coupled to a riser and having a muzzle end and a breach end adapted to be coupled to a string release, said sabot comprising:

a front end and a nock end with a string guide slot for engaging the bowstring;

a top portion and a bottom portion adapted to be inserted into the muzzle end of the elongated track;

the top portion and the bottom portion each having at least one slot adapted to receive at least one projectile; and the top portion and the bottom portion each adapted to separate when launched to release the projectiles.

36. An archery bow, comprising:

first and second limbs, each having first and second ends;

a riser to receive the first end of the first and second limbs;

a first wheel with an axle to couple to the second end of the first limb;

a second wheel with an axle to couple to the second end of the second limb;

a bowstring extending between the first wheel and the second wheel;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least one slot adapted to receive at least one projectile, the sabot having a front end and a nock end for engaging the bowstring, and the top portion and a bottom portion each have a front end that has a beveled surface that extends inward and being adapted to separate when launched to release the projectiles.

37. An archery bow, comprising:

first and second limbs, each having first and second ends;

a riser to receive the first end of the first and second limbs;

a first wheel with an axle to couple to the second end of the first limb;

a second wheel with an axle to couple to the second end of the second limb;

a bowstring extending between the first wheel and the second wheel;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least one slot adapted to receive at least one projectile, the sabot having a front end and a nock end for engaging the bowstring, and the top portion and a bottom portion each have a front end that has a convex conical surface that extends inward and being adapted to separate when launched to release the projectiles.

38. An archery bow, comprising:

first and second limbs, each having first and second ends;

a riser to receive the first end of the first and second limbs;

a first wheel with an axle to couple to the second end of the first limb;

a second wheel with an axle to couple to the second end of the second limb;

a bowstring extending between the first wheel and the second wheel;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least three slots each adapted to receive at least one projectile, the sabot having a front end and a nook end for engaging the bowstring, and the top portion and a bottom portion adapted to separate when launched to release the projectiles.

39. An archery bow, comprising:

first and second limbs, each having first and second ends;

a riser to receive the first end of the first and second limbs;

a first wheel with an axle to Couple to the second end of the first limb;

a second wheel with an axle to couple to the second end of the second limb;

a bowstring extending between the first wheel and the second wheel;

a string release;

an arrow rest assembly comprised of an elongated track coupled to the riser and having a muzzle end and a breach end adapted to be coupled to the string release; and a sabot adapted to be inserted into the muzzle end of the elongated track, the sabot having a top portion and a bottom portion each having at least one slot adapted to receive at least one projectile, the sabot having a front end and a nock end with a string guide slot for engaging the bowstring, and the top portion and a bottom portion adapted to separate when launched to release the projectiles.

* * * * *